US005597947A

United States Patent [19]

Stephens

[11] Patent Number: 5,597,947

[45] Date of Patent: Jan. 28, 1997

[54] HIGH ENERGY FUEL GEL SLURRIES

[75] Inventor: William D. Stephens, Huntsville, Ala.

[73] Assignee: The United States of America as represented by the Secretary of the Army, Washington, D.C.

[21] Appl. No.: 578,004

[22] Filed: Dec. 22, 1995

[51] Int. Cl.[6] ..... C10L 7/00

[52] U.S. Cl. ..... 44/268; 44/272

[58] Field of Search ..... 44/268, 272

[56] References Cited

U.S. PATENT DOCUMENTS

| | | | |
|---|---|---|---|
| 2,902,351 | 9/1959 | Stokes et al. | 44/268 |
| 3,323,883 | 6/1967 | Hotten | 44/272 |
| 3,795,556 | 3/1974 | Sippel et al. | 44/268 X |
| 4,007,128 | 2/1977 | Poklacki | 44/268 X |
| 4,039,360 | 8/1977 | Allan | 149/36 |
| 5,514,645 | 5/1996 | McCabe et al. | 44/268 X |

OTHER PUBLICATIONS

"Self–Propagating Process of Sintering of Ultradisperse Metal Powders" G. V. Ivandv, et al. Sov. Phys. DokL 29 (4) Apr. 1984, pp. 331–332.

"Investigation into Particles formed by electrical explosion of conductors" by Yu. A. Kotov, Physics Abstracts, vol. 82, No. 1112 (15 May 19, 1979). (Fig & KHIM. Obrab. Mater (USSR), No. 4, pp. 24–29 (Jul.–Aug. 1978) in Russia).

*Primary Examiner*—Peter A. Nelson

*Attorney, Agent, or Firm*—Hugh P. Nicholson; Freddie M. Bush

[57] ABSTRACT

This invention involves a process for improving the energy and ignitability of a metal slurry gel rocket fuel by the use of an energetic metal compound of higher energy than the parent metal. An energetic metal compound is added slowly to a liquid rocket fuel with appropriate stirring to form a suspension of the metallic compound in the liquid fuel. To this is added a small quantity of a gelling agent, such as silicon dioxide, with stirring, to form an energetic metal fuel gel. The energetic metal compound is prepared by using a high purity metal in the form of a wire. As an example, a sample of aluminum wire weighing 2.26 grams is supplied with an external source of high voltage and amperes, while the wire is in an environment of an inert gas (e.g., argon) under about 40 atmospheres pressure, to achieve electrical explosion of the wire. The product produced is a fine, gray, non-conductive powder in high yield. This powder contains aluminum and argon. This powder can be used to replace the aluminum of a prior art thixotropic fuel gel to obtain a thixotropic fuel gel with an improved performance with higher energy.

5 Claims, No Drawings

HIGH ENERGY FUEL GEL SLURRIES

DEDICATORY CLAUSE

The invention described herein may be manufactured, used, and licensed by or for the Government for governmental purposes without the payment to me of any royalties thereon,

BACKGROUND OF THE INVENTION

Liquid propellant rockets produce thrust by the combustion of a liquid fuel with a liquid oxidizer in a combustion chamber, in which the hot combustion gases exit to a nozzle exit cone assembly producing forward motion of the rocket motor. In the liquid propellant rocket motor, fuel and oxidizer are separated in different tanks. It is a common practice to use an expulsion system to pressurize the liquid fuel and the liquid oxidizer in order to force the materials into the combustion chamber. In previous applications, increases in fuel energy and fuel density have been achieved by use of a slurry of aluminum or other metal powder in the fuel carrier liquid. In many instances, the fuel carrier liquid is a hydrocarbon, a nitrogen containing material, which is a derivative of urea or hydrazine, or a liquid organo metallic fuel. An improvement to liquid propulsion rockets, has been achieved by the use of gelling techniques in which the liquid fuel and liquid oxidizer are gelled by addition of small percentages of very finely divided gelling agent, such as silicon dioxide powder, which converts the liquid into a gel. The advantages of gellation are due to the fact that these materials will not spill or run. The gels have the characteristics of semi-solids until they are pressurized. When work is put into the gel, in the form of pressure or vibration, the gel will flow with characteristics of a liquid.

Gelled propellant fuel such as a thixotropic rocket fuel comprised of monomethylhydrazine, metallic fuel particles, dimethylurea, and a gellant is disclosed in U.S. Pat. No. 4,039,360 for a commonly assigned invention issued to Barry D. Allan on Aug. 2, 1977. This thixotropic fuel gel has the ability even with low gellant concentration to maintain metallic fuel particles dispersed therein even under several hundred g's loading. For applications where fuel tank volume is limited, it is desirable to increase the density of the fuel (by adding metallic fuel particles) while maintaining a high specific impulse.

Slurred fuels used in the past can be illustrated by a slurry containing aluminum powder, slurred in a material such as dimethyl hydrazine. The current state-of-the-art of slurred fuel of this sort is to use a liquid fuel, solid metallic additive, and a gelling agent, such as silica.

The primary objective of this invention is to provide a higher energy from metallic fuel gel slurries.

SUMMARY OF THE INVENTION

This invention involves a process for improving the energy and ignitability of a metal slurry gel rocket fuel by the use of an energetic metal compound of higher energy than the parent metal. Energetic metal compounds may be made by a method in which a metallic wire is exploded in the presence of an inert gas forming an energetic metal powder comprised of the metallic wire and the inert gas. These energetic metal powders have a higher energy and greater ease of ignition than the parent metal, and therefore, are capable of providing gel slurry fuel compositions of higher energy and greater ease of ignition.

DESCRIPTION OF PREFERRED EMBODIMENT

This invention discloses a higher energy fuel for liquid rockets in which an energetic metal compound is suspended in a fuel carrier, by means of a gelling agent. An energetic metal compound is added slowly to a liquid rocket fuel with appropriate stirring to form a suspension of the metallic compound in the liquid fuel. To this is added a small quantity of the gelling agent, such as silicon dioxide, with stirring, to form an energetic metal fuel gel. The energetic metal compound is prepared by using a high purity metal in the form of a wire. As an example, a sample of aluminum wire weighing 2.26 grams is supplied with an external source of high voltage and amperes, while the wire is in an environment of an inert gas (e.g., argon) under about 40 atmospheres pressure, to achieve electrical explosion of the wire. The product produced is a fine, gray, non-conductive powder in high yield. This powder contains aluminum and argon.

The powders included in this invention are metals combined with an inert or noble gas as further defined hereinbelow. In addition to aluminum combined with argon, other examples are aluminum combined with helium, neon, xenon, krypton, or radon. Metals may be selected from beryllium, lithium, boron, sodium, magnesium, silicon, potassium, calcium, manganese, iron, cobalt, nickel, copper, zinc, lead, tin, antimony, gold, bismuth, and zirconium.

The energetic metal compound is added slowly to a liquid rocket fuel with appropriate stirring to form a suspension of the metallic compound in the liquid fuel. To this suspension is added a small quantity of the gelling agent, such as silicon dioxide, with stirring, to form an energetic metal fuel gel slurry.

An improved thixotropic fuel gel results from utilizing the prior art gellant hydroxypropyl cellulose in an amount of 1.4% by weight, the prior art additive of dimethylurea in an amount of 0.1% by weight,the prior art liquid fuel of monomethylhydrazine in an amount of 38.5% by weight, and the energetic aluminum non-conductive powder as defined hereinabove to replace the prior art aluminum powder in an amount of 69.0% by weight.

While the present invention has been described by specific embodiments thereof, it should not be limited thereto since obvious modifications will occur to those skilled in the art without departing from the spirit of the invention or the scope of the following claims.

I claim:

1. A slurry fuel composition comprising:

(i) an energetic metal non-conductive powder prepared by subjecting a high purity metal, which is in an environment of an inert or noble gas under about 40 atmospheres pressure, to an external source of high voltage and amperes to achieve electrical explosion of said high purity metal, said high purity metal selected from the group consisting of aluminum, antimony, beryllium, bismuth, boron, calcium, cobalt, copper, gold, iron, lead, lithium, magnesium, manganese, nickel, potassium, silicon sodium, tin, zinc, and zirconium, said inert or noble gas selected from the group consisting of argon helium, neon, krypton, radon, and xenon;

(ii) a liquid fuel with said energetic metal non-conductive powder suspended therein by means of a gelling agent.

2. The slurry fuel composition as defined in claim 1 wherein said slurry fuel composition is a liquid gelled rocket fuel.

3. The liquid gelled rocket fuel as defined in claim 2 wherein said liquid fuel is dimethyl hydrazine and wherein said gelling agent is silicon dioxide.

4. A thixotropic fuel gel composition comprising:

(i) an energetic metal non-conductive powder in an amount of 60.0% by weight prepared by subjecting a high purity metal, which is in an environment of an inert or noble gas under about 40 atmospheres pressure, to an external source of high voltage and amperes to achieve electrical explosion of said high purity metal, said high purity metal selected from the group consisting of aluminum, antimony, beryllium, bismuth, boron, calcium, cobalt, copper, gold, iron, lead, lithium, magnesium, manganese, nickel, potassium, silicon sodium, tin, zinc, and zirconium, said inert or noble gas selected from the group consisting of argon helium, neon, krypton, radon, and xenon;

(ii) a gellant of hydroxypropyl cellulose in an amount of 1.4% by weight;

(iii) an additive of dimethyurea in an amount of 0.1% by weight; and, (iv) a liquid fuel of monomethlyhydrazine in an amount of 38.5% by weight.

5. The thixotropic fuel gel composition as defined in claim 4 wherein said energetic metal non-conductive powder contains aluminum and argon.

* * * * *